United States Patent [19]

Oliver et al.

[11] 3,967,255

[45] June 29, 1976

[54] FLAME DETECTION SYSTEM

[75] Inventors: Stuart M. Oliver, Los Angeles; Ralph A. Proud, Jr., Pasadena; Sanford J. Parsons, Richmond, all of Calif.

[73] Assignees: The Delphian Foundation, Sheridan, Oreg.; $Q^2$ Corporation, Los Angeles, Calif. ; a part interest to each

[22] Filed: June 28, 1974

[21] Appl. No.: 484,283

[52] U.S. Cl. ..... 340/227 R; 340/228 R; 250/554

[51] Int. Cl.[2] ..... G08B 21/00

[58] Field of Search ..... 340/227 R, 228 R; 250/338, 339, 206, 215, 554

[56] References Cited

UNITED STATES PATENTS

| | | | |
|---|---|---|---|
| 2,897,485 | 7/1959 | Johnson | 340/228 R |
| 3,122,638 | 2/1964 | Steele et al. | 340/228 R UX |
| 3,222,661 | 12/1965 | Vasel et al. | 340/228 R |
| 3,235,860 | 2/1966 | Vassil | 340/228 R |
| 3,633,192 | 1/1972 | Neiger | 250/554 X |
| 3,651,442 | 3/1972 | Vasel | 250/554 |
| 3,689,773 | 9/1972 | Wheeler | 250/554 |
| 3,725,660 | 4/1973 | Doherty | 250/338 |
| 3,753,258 | 8/1973 | Honda | 340/228 R |

*Primary Examiner*—John W. Caldwell
*Assistant Examiner*—William M. Wannisky
*Attorney, Agent, or Firm*—Norman Zafman; Theodore Scott Park

[57] ABSTRACT

A flame detection system comprising two light responsive photovoltaic photocell sensors in combination with corresponding light filters, a photovoltaic sensing amplifier, a control amplifier, and a power source. The photocell/filter combinations are responsive to spectral energy in two different regions of the spectrum, said regions being such that illumination from a hydrocarbon flame causes a reversal in voltage polarity of the signal from the pair of photovoltaic photocells. The photovoltaic photocells are serially connected in voltage opposition and the voltage produced by the combination is applied as an input coupled to the sensing amplifier. The latter is arranged and configured to respond to a selected voltage polarity generated by the photovoltaic combination, when illuminated by a hydrocarbon flame, by providing a control signal to the control amplifier. The control amplifier is typically coupled to a relay and/or solenoid valve which controls the turn-on of a fire alarm and/or extinguishing means. Whenever the control amplifier receives a control signal (indicative of the presence of a hydrocarbon flame), it activates the relay and/or solenoid valve and, thereby, causes the alarm and/or extinguishing means to turn on.

20 Claims, 12 Drawing Figures

Fig. 1a

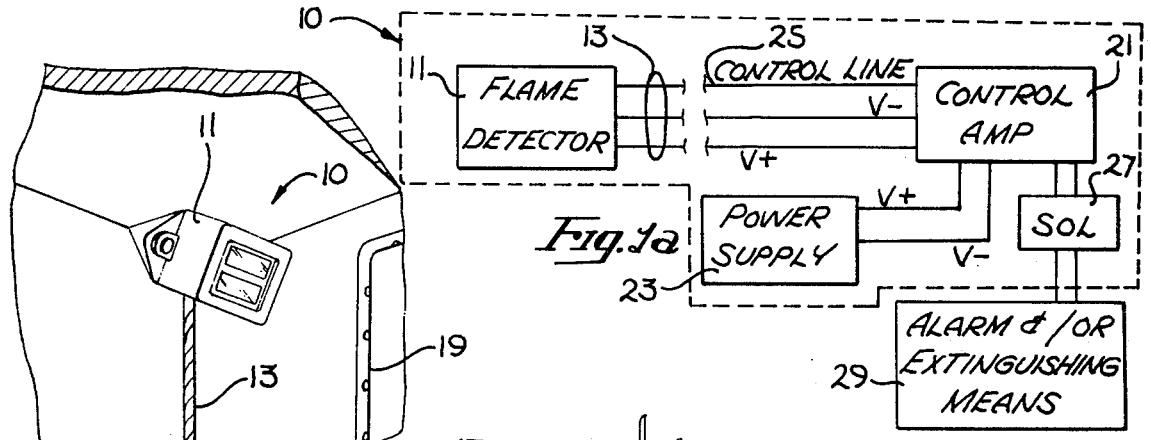
Fig. 1a
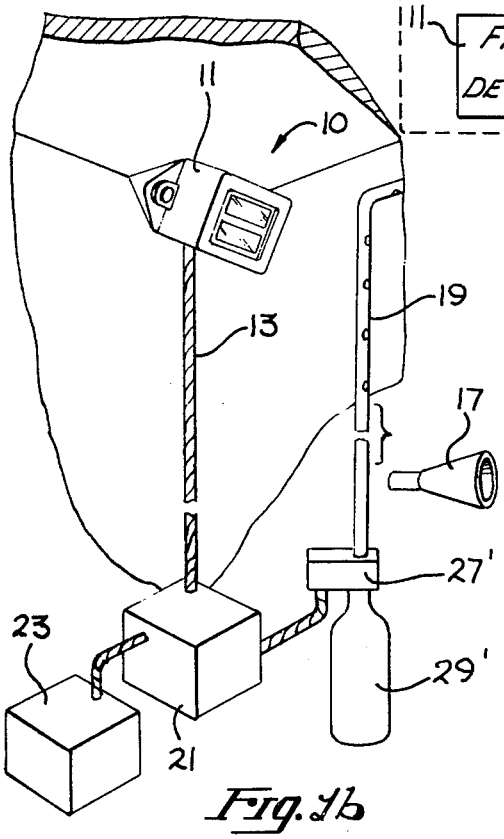
Fig. 1b
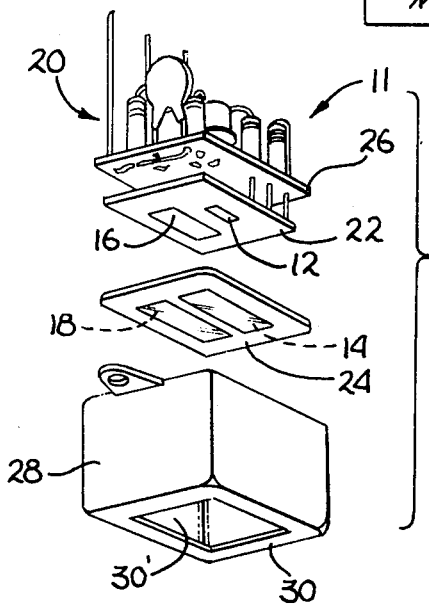
Fig. 2
Fig. 3
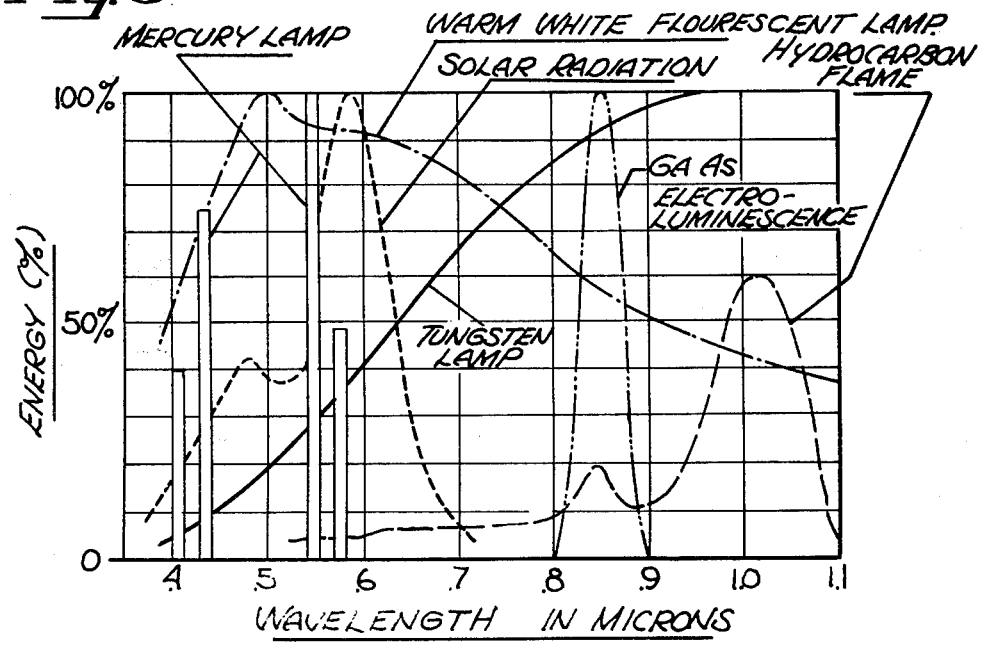

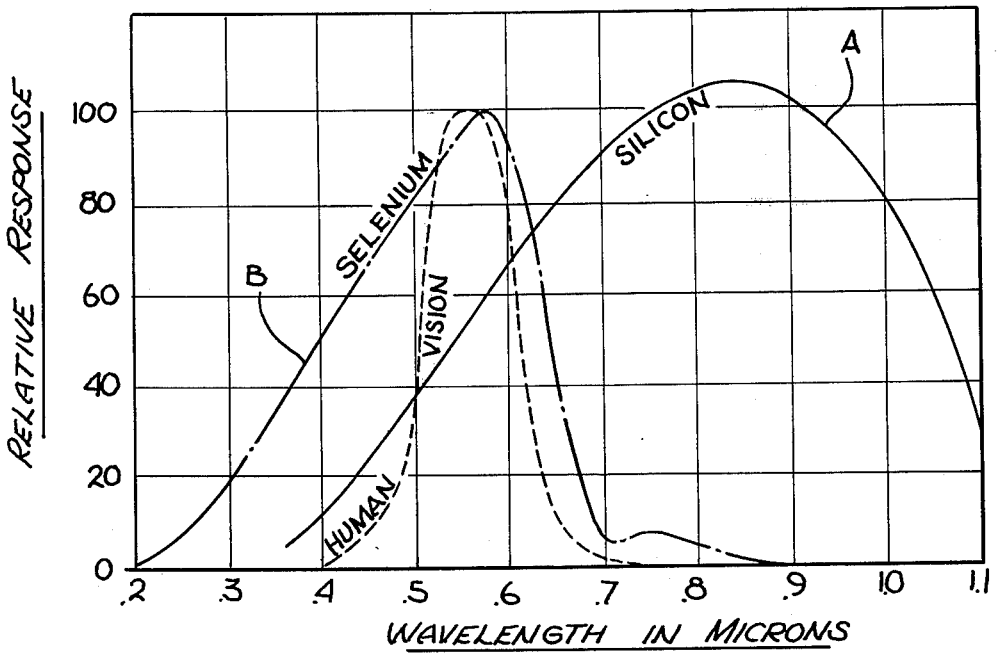
Fig. 4
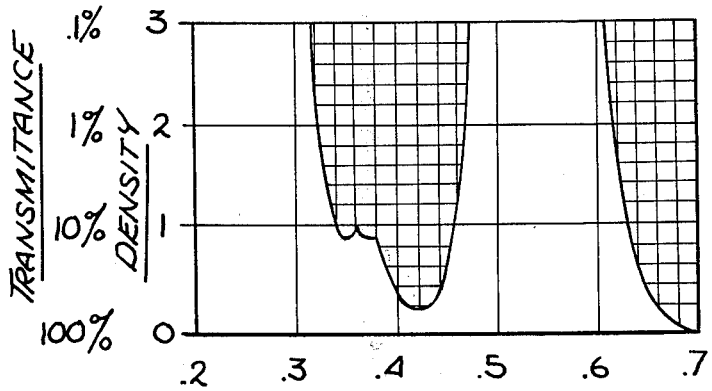
Fig. 5a
Fig. 5b
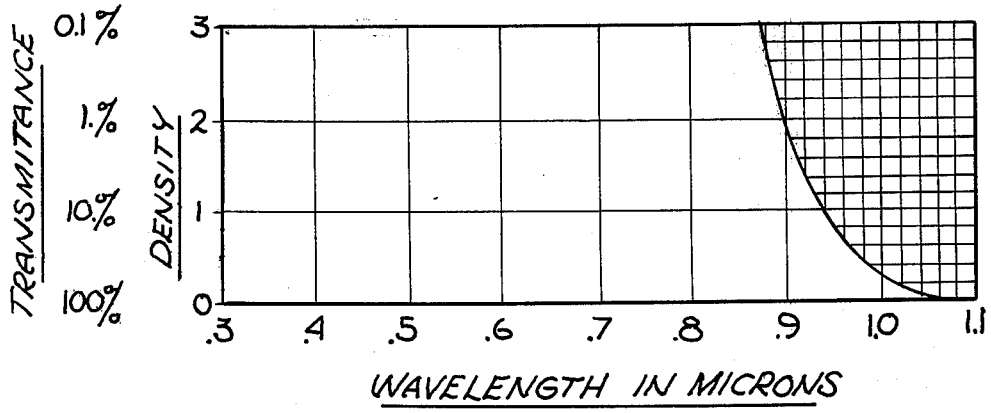

RELATIVE RESPONSE
100
80
60
40
20
0
.2
.3
.4
.5
.6
.7
.8
.9
1.0
1.1
SELENIUM PHOTOCELL 16
AND FILTER 18
COMBINATION
SILICON PHOTOCELL
12, AND FILTER 14
COMBINATION
B
A

RELATIVE SIGNAL STRENGTH
100
80
60
40
20
0
.3
.4
.5
.6
.7
.8
.9
1.0
1.1
MERCURY LAMP
SOLAR RADIATION
SOLAR RADIATION
HYDROCARBON FLAME

RELATIVE SIGNAL STRENGTH
100
80
60
40
20
0
.3
.4
.5
.6
.7
.8
.9
1.0
1.1
WARM WHITE FLUORESENT LAMP
TUNGSTEN LAMP
GAS AS ELECTRO LUMINESENCE

FLAME DETECTION SYSTEM

BACKGROUND OF THE INVENTION

1. Field of the Invention

This invention relates to the field of fire detection and, more particularly, to a fire detection system responsive to the unique spectral energy characteristic of a hydrocarbon flame.

2. Prior Art

The use of light responsive photocells in conjunction with wavelength selective filters for the discrimination and detection of a particular light source from among several sources is known to the prior art. However, flame detection systems known in the prior art have generally operated on the principle of detecting one or more bands in the spectrum which are characteristic of a particular type of flame. Typically, two or more identical photocells are utilized together with multi-layer wavelength selective filters, the latter being produced especially for the application by vapor deposition techniques. Since the photocells are identical and have substantially the same response, the attainment of wavelength selectivity must perforce be due entirely to the design of the filters. Consequently, the cost of such flame detection systems is relatively expensive, due in large measure to the requirement for specially designed filters.

The present invention overcomes the foregoing shortcomings by teaching the use of two different photovoltaic devices; having respective spectral responses in different photovoltaic portions of the spectrum. Using two different photocells, e.g., silicon and selenium photovoltaic cell diodes, this invention operates on the principle of detecting the presence of spectral energy in the band of one of the photocells, and the absence of significant spectral energy in the band of the other. By this technique, the use of commercially available off-the-shelf filters is enabled, thereby reducing the cost of the invention system substantially below that of systems heretofore known; e.g., relatively inexpensive Wratten gelatin filters and other chemical filters are suitable for use in this invention. Moreover, notwithstanding the significant economic advantage of the invented system with respect to systems of the prior art, the invented system has superior performance characteristics.

One flame detection system of the prior art utilizes a gas filled Geiger-Muller tube. It operates by detecting the rich ultraviolet light energy characteristic of a flame (in the 0.2 to 0.25 micron range). This system has the disadvantage of being both relatively expensive and also slow in response time. In the latter connection, systems utilizing a Geiger-Muller tube typically discriminate on the basis of the rate of an output pulse train. This requires an integration over a period of time, typically 30 seconds, before a response is forthcoming. Still another flame detection system of the prior art utilizes a pair of cadmium sulfide photocells in an electrical bridge configuration. The cadmium sulfide photocells are relatively expensive, photo-conductive devices. Moreover, they are limited by a relatively narrow spectral response characteristic. The present invention does not suffer from the shortcomings and disadvantages of flame detection systems which utilize Geiger-Muller tubes and cadmium sulfide photocells.

BRIEF SUMMARY OF THE INVENTION

The present invention is a fire detection system which is responsive to the unique spectral energy characteristic or "signature" of a hydrocarbon flame. It is comprised of a flame detector, a control amplifier and a source of d.c. power.

The flame detector comprises a pair of light responsive photovoltaic photocells, a corresponding pair of wavelength selective filters and a sensing amplifier. The pair of photovoltaic photocell/filter combinations is selected to provide a spectral response in two regions of the spectrum, one region (the infrared) being that within which a hydrocarbon flame has relatively abundant spectral energy, and the second region (the blue) being that within which a hydrocarbon flame has relatively little spectral energy. When the photocells are illuminated by light from a hydrocarbon flame (through their respective filters), the signal generated by one photocell (the one related to the infrared region) is substantially greater than that generated by the second photocell (the one related to the blue region). This signal response of the two photocells to a hydrocarbon flame is unique in that all other common sources of illumination cause a different signal response from the photocells. Certain sources of light cause the photocell related to the blue region to generate a greater signal that that of the other photocell. Still other common sources of light cause approximately equal signals from the two photocells. In some cases, such as that of a tunsten lamp, the photocell related to the infrared region generates a larger signal than that generated by the other photocell. However, the difference between the two signals is not as great as the difference in relative photocell signal strength characteristic of a hydrocarbon flame; thus, even in the latter cases, the flame detector can distinguish a hydrocarbon flame from other such sources of light.

The photocells are mounted in a co-planar configuration on a board, typically a circuit board. The filters are disposed upon a planar filter reticle having the same approximate dimensions as the board on which the photocells are mounted. Corresponding surfaces of the board and reticle are engaged in juxtaposition so that each filter covers the photocell with which it is associated. The filters are either bonded to the reticle by a suitable adhesive or by conventional vacuum deposition techniques. The photocells and filters are disposed within a housing, together with the electronic components comprising the sensing amplifier. The housing has a suitable opening to permit spectral energy from all sources within the field of view of the photocells to pass through the filters to the photocells.

The two photocells are electrically coupled in series to the input of the sensing amplifier, in opposing directions. The sensing amplifier is a high speed switching circuit comprised of a conventional operational amplifier having two input legs. The output state of the operational amplifier is a binary function of which of the two input legs has the higher voltage thereon. When illumination from a hydrocarbon flame is incident upon the photovoltaic photocells (with sufficient intensity), the resulting voltages at the input legs of the operational amplifier are such that the state of amplifier's output is that state which represents the detection of a flame. In darkness, and when the photocells are illuminated by sources of light other than a hydrocarbon flame, the electrical signals generated by the photocells cause the voltages on the input legs of the operational amplifier to be such that the state of the amplifier's output is that state representative of a quiescent (or non-flame) condition.

The change of state of the operational amplifier's output to that representing a flame detection state serves as a control signal to a remotely located control amplifier. The control amplifier is electrically coupled to a relay and/or solenoid valve which is itself coupled to a fire alarm and/or extinguishing means. The control amplifier responds to the control signal by energizing the relay and/or solenoid valve, which in turn, activates the alarm and/or extinguishing means, such as, for example, a valve controlled water or halon sprinkler system, and/or a bell or siren.

Other objects, novel features and advantages of the present invention will become apparent upon making reference to the following detailed description and the accompanying drawings. The description and the drawings will also further disclose the characteristics of this invention, both as to its structure and its mode of operation. Although a preferred embodiment of the invention is described hereinbelow, and shown in the accompanying drawing, it is expressly understood that the descriptions and drawings thereof are for the purpose of illustration only and do not limit the scope of this invention.

BRIEF DESCRIPTION OF THE DRAWINGS

In the accompanying drawings, in which a preferred embodiment of the present invention is illustrated:

FIG. 1*a* is a functional block diagram of the invented flame detection system operating an alarm and/or fire extinguishing means through an actuating relay and/or solenoid valve.

FIG. 1*b* is a front perspective view of the present invention as it appears when installed, the flame detector portion thereof being located in the upper corner of a room.

FIG. 2 is a front perspective, broken apart view of the flame detector portion of the invention, showing how its constituent photocells, filters, and sensing amplifier are assembled.

FIG. 3 shows the spectral energy characteristic of various light sources.

FIG. 4 shows in Curves A and B thereof, the spectral responses of typical silicon and selenium photocells respectively, and for comparison, the spectral response of human vision.

FIG. 5*a* shows the light energy transmittance characteristic of the filter which covers the selenium photocell in the flame detector portion of the invention.

FIG. 5*b* shows the light energy transmittance characteristic of the filter which covers the silicon photocell in the flame detector portion of the invention.

DETAILED DESCRIPTION OF THE INVENTION

Figure 6:
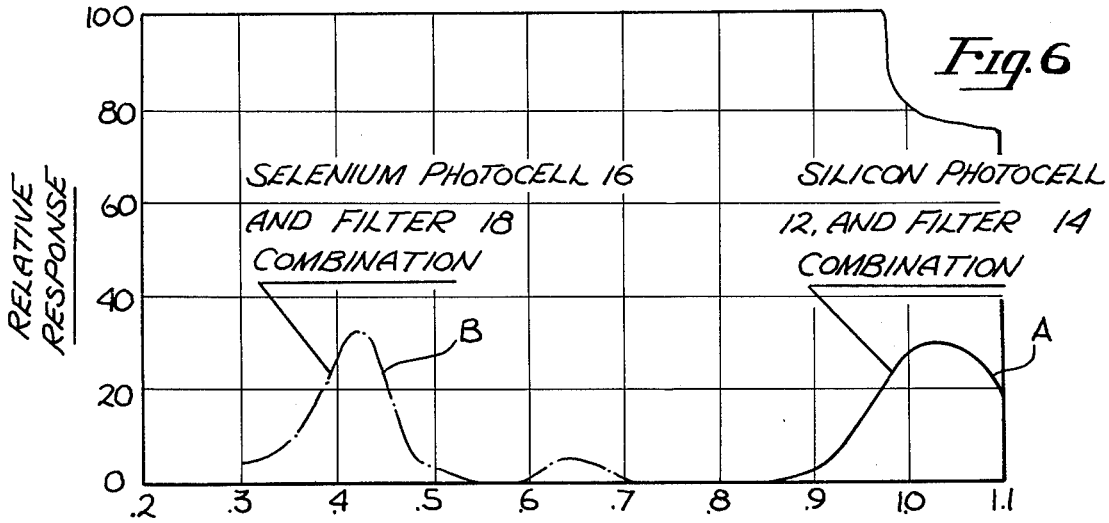
FIG. 6 shows the spectral responses of the combinations comprising (i) the silicon photocell of FIG. 4 and the filter of FIG. 5*b* (Curve A), and (ii) the selenium photocell of FIG. 4 and the filter of FIG. 5*a* (Curve B).

With reference to FIGS. 1*a* and 1*b*, a preferred embodiment of the present invention 10 is described in detail. The invention 10 is comprised of (i) a flame detector 11; (ii) a control amplifier 21 and power supply 23. The flame detector 11 is arranged and configured to detect the presence of a hydrocarbon flame within its range and field of view, as more fully described hereinbelow. When a hydrocarbon flame is detected by the flame detector 11, it transmits a control signal to control amplifier 21, typically located somewhere remote from the detector, over control line 25. In response to the control signal, control amplifier 21 activates a relay and/or solenoid valve 27 which, in turn, activates a fire alarm and/or extinguishing means 29. The relay and/or solenoid valve 27 and alarm and/or extinguishing means 29 are not considered part of the present invention, but operate cooperatively with the invention to achieve the desired result; i.e., the issuance of a fire alarm and/or the activation of a suitable fire extinguishing means. Many suitable fire alarm and extinguishing means are available in the trade, including bells, sirens, flashing lights, water sprinkler systems, and halon systems. Power supply 23 provides d.c. voltages V+ and V− both to the flame detector 11 and control amplifier 21. V− may be a negative voltage or merely a power supply return line. Power supply 23 may be comprised of one or more batteries or a more sophisticated electronic power supply adapted to operate from any conventional source of AC power.

FIG. 1*b* depicts a typical installation of the invention 10. At least one flame detector 11 is shown installed in an upper corner of the room or structure wherein the flame detection system is installed. Located remotely from the flame detector 11 is power supply 23 and control amplifier 21. A cable 13 interconnects the control line 25, and the lines carrying supply voltages V+ and V−, between the flame detector 11 and control amplifier 21. A conventional solenoid valve assembly 27', activated by control amplifier 21, is shown connected to a fire extinguishing freon bottle 29'. When the solenoid valve assembly 27' is activated, halon is discharged into either a nozzle 17 or a sprinkler pipe distribution system 19. It should be understood, however, that this invention is not limited to the particular installation shown in FIG. 1*b*. There are as many ways in which the invention can be applied and installed as there are structures and property to be protected by a flame detection system.

The Flame Detector

Flame detector 11 is comprised of (i) a first combination of a photovoltaic photocell sensor 12 and a light energy filter 14; (ii) a second combination of a photovoltaic photocell sensor 16 and a light filter 18; and (iii) a sensing amplifier 20 electrically coupled to the photovoltaic photocells 14 and 16.

With reference to FIG. 2, the physical configuration of the flame detector 11 is described in detail. Photovoltaic sensors 12 and 16 are installed in adjacent spaces formed within a circuit board 22. Various means for securing the photocells 12 and 16 to board 22 are well known in the art and the particular means employed is not part of this invention. Photocells 12 and 16 are substantially co-planar in board 22. Filters 14 and 18 are disposed on a filter reticle 24 at corresponding co-planar, adjacent positions on the backside thereof. A typical reticle 24 is made from glass having clear and opaque portions. The portions of the reticle 24 on which filters 14 and 18 are disposed are clear in order to enable light to pass through the filters 14 and 18 (and through the filters to photocells 12 and 16 respectively). The filters 14 and 18 may be secured to the surface of reticle 24 by an adhesive or by vacuum deposition techniques. Among the suitable adhesives available in the trade are gelatin based adhesives and Canadian balsam. The characteristics required of a suitable adhesive are (i) that it be transparent over the wavelengths of interest and (ii) that it have no adverse effect upon the filters.

Circuit board 22 and reticle 24 are typically of the same dimensions, and when the flame detector 11 is assembled, the planar surfaces of board 22 and reticle 24 are engaged in juxtaposition. The respective locations of filters 14 and 18 on reticle 24 are such that, when the detector 11 is assembled, filter 14 engages and covers the entire surface of corresponding photocell 12 and filter 18 engages and covers the entire surface of corresponding photocell 16.

Disposed behind board 22 and electrically coupled to photocells 12 and 16 is the sensing amplifier 20. Sensing amplifier 20 is comprised of a combination of electronic components mounted on a circuit board 26, preferably a printed circuit board. A preferred embodiment of sensing amplifier 20 is shown schematically in FIG. 8 and described in detail hereinbelow. The reticle 24 containing the filters 14 and 18, board 22 containing photocells 12 and 16, and sensing amplifier 20 are disposed within a housing 28 in the order shown in FIG. 2; i.e., the filter reticle 24 in first, the board 22 next and the sensing amplifier last. Housing 28 has an opening 30' in its face side 30 to enable light to enter. Reticle 24 rests on the inside surface of the face side 30 of housing 28. Thus, light passing through opening 30' passes first through the clear portions of reticle 24 and thence through filters 14 and 18. Housing 28 also has lugs 32 to enable it to be fastened to wall, ceiling, or wherever its installation is desired. The dimensions of housing 28 are typically about 1 × 1 ⅛ × 1 inches in length, width, and height respectively, and opening 30' in its face side 20 is typical about ¾ × ¾ inches. Of course, other physical configurations of the flame detector 11, as well as variations in its dimensions, are possible without departing from the spirit and scope of this invention.

In a preferred embodiment of this invention, photocell sensor 12 is a silicon photovoltaic cell diode such as photodiode No. 58 CL manufactured by Centralab. The spectral response of this photocell 12 is shown in Curve A of FIG. 4. As can be seen, it is responsive from about 0.4 to 1.1 microns, with a peak response at about 0.85 microns. Filter 14, which filters the light incident upon photocell 12, is preferably a filter having the light transmittance characteristics similar to that shown in FIG. 5*b*. There are a number of wavelength selective filters available in the art which could provide the requisite transmittance characteristic of filter 14. Among these, for example, are filters produced by conventional vacuum, vapor deposition techniques, Wratten gelatin filter No. 87A and selective glass filters made by Zeiss, Corning and Schott.

Transmission by filter 14 begins at about 0.85 microns and approaches 100% transmittance at about 1.1 microns, thereby passing much of the infrared portion of the spectrum. It is, of course, the spectral response of the combination of photocell 12 and filter 14 which is of significance in this invention. The spectral response of the combination is the product of the spectral response of the photocell 12 and transmittance of the filter 14. The spectral response of the latter combination is shown in curve A of FIG. 6. As seen, the spectral response of this combination is in the range from about 0.9 to 1.1 microns with a peak between 1.0 and 1.05 microns.

In this preferred embodiment, photocell sensor 16 is a selenium photovoltaic cell diode such as the photodiode No. Z5X-10LB manufactured by Vac-Tec. The special response of this potocell 16 is shown in curve B of FIG. 4. As can be seen, it is responsive from about 0.2 to 0.8 microns, with a peak at about 0.57 microns. Filter 18, used in conjunction with photocell 16 to filter the light incident thereon is preferably one having the light transmittance characteristic similar to that shown in FIG. 5*a*. As indicated above, a number of filters are available in the art having the requisite transmittance, including Wratten gelatin filter No. 35.

Transmission by filter 18 begins at about 0.32 microns and peaks near 100% at about 0.43 microns. After 0.43 microns transmittance falls off sharply. Thus, filter 18 transmits the blues and some greens of the visible spectrum. Wratten filter No. 35, suitable for filter 18, also has a second transmittance lobe starting at about 0.61 microns. However, this lobe is not of interest and its effect is of little consequence because, above 0.6 microns, the spectral response of the selenium photocell 16 falls off very sharply. As in the case of photocell 12 and filter 14, it is the response of the combination of photocell 16 and filter 18 which is of importance in this invention. The spectral response of the latter combination is shown in Curve B of FIG. 6. It can be seen that the spectral response is in the range from about 0.3 to 0.5 microns with a peak between 0.4 and 0.45 microns. The response about 0.6 microns is relatively low.

It is known that silicon and selenium photovoltaic diodes have different sensitivities, efficiencies, and impedances. Thus, the present invention teaches the balancing of the two photocells 12 and 14 with respect to these characteristics. Sensitivity is defined as the number of photons per second which must be incident upon the photocell before a measurable electrical response can be detected. The differences in sensitivity can be balanced in flame detector 11 by selecting appropriate surface areas for the photocells 12 and 16. Since the sensitivity of selenium photocells, per unit area, is less than that of silicon photocells, the area of the selenium photocell 16 must be correspondingly larger than that of the silicon photocell 12 in order to achieve the requisite balance of sensitivity. The difference in the relative surface areas of photocells 12 and 16 is seen in FIG. 2.

The efficiency of a photocell is defined as the ratio of the number of electrons transferred over the number of photons present at the frequency of interest; thus, a photocell has greater efficiency; i.e., is more responsive, if more electrons are transferred per photon incident thereon. As is the case with respect to sensitivity, the efficiency of selenium photocells is lower than that of silicon photocells. This difference can be balanced in flame detector 11 by selecting the surface area of the selenium photocell 16 to be correspondingly larger than that of silicon photocell 12. The respective surface areas of photocells 12 and 16 can be selected so as to reasonably balance out their different sensitivities and efficiencies. The difference in the respective impedances of the two photocells 12 and 16 may be balanced out by connecting a resistor of appropriate value in parallel across the photocell having the higher impedance, typically the silicon photocell 12.

Figure 7A:
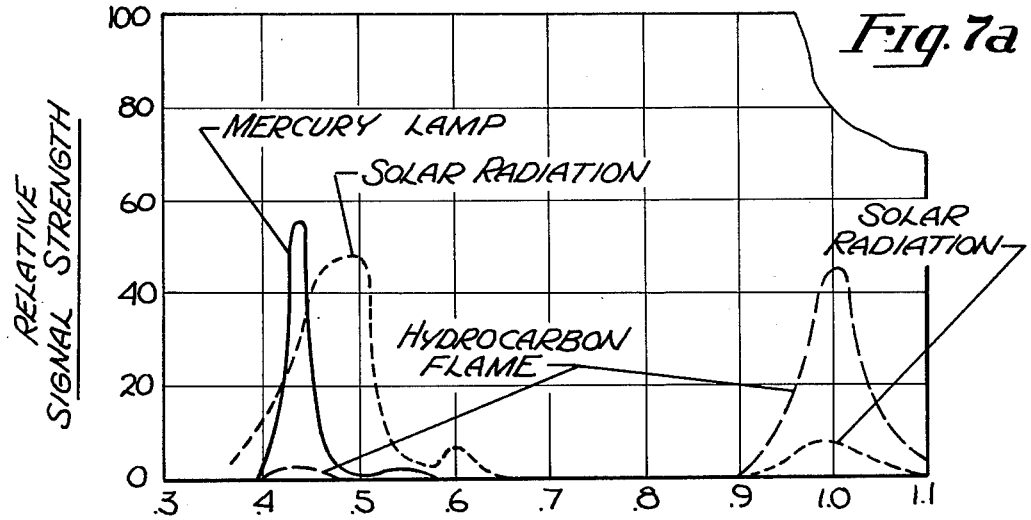
FIG. 7*a* shows the signal output of the photocell and filter combinations of FIG. 6 when illuminated by light energy from a mercury lamp, solar radiation, and a hydrocarbon flame.
Figure 7B:
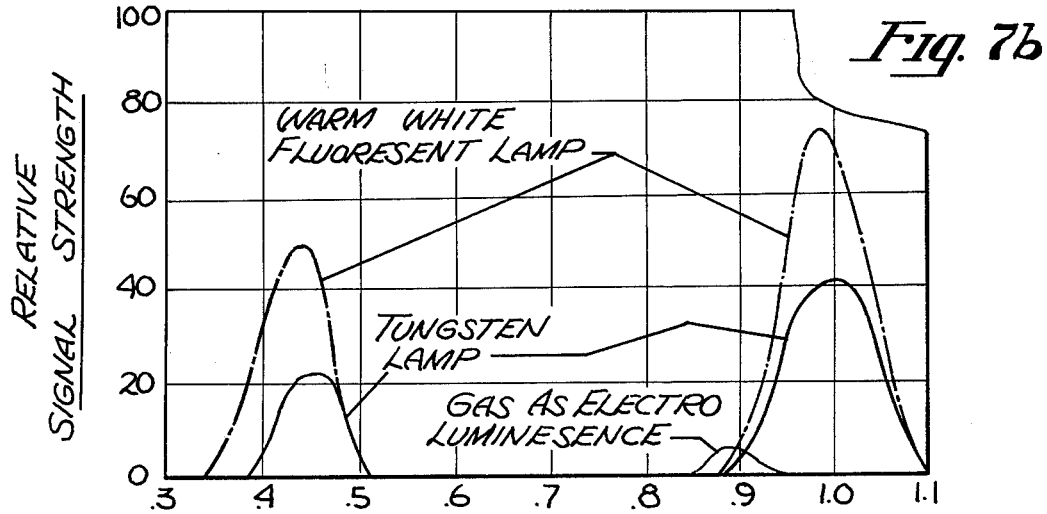
FIG. 7*b* shows the signal output of the photocell and filter combinations of FIG. 6 when illuminated by light energy from a tunsten lamp, a warm white fluorescent lamp, and galium arsenide (GaAs) electro-luminescence.
Figure 9:
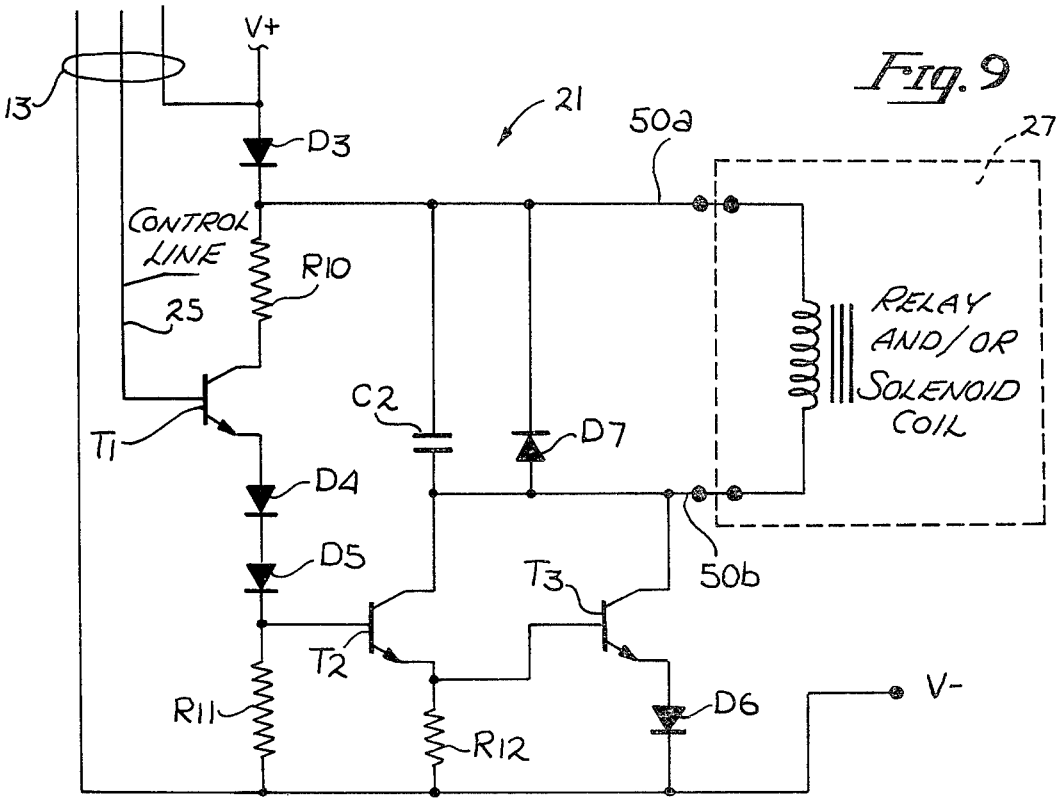
FIG. 9 is a schematic representation of the control amplifier portion of the present invention.

The object of the flame detector 11 is to detect the presence of hydrocarbon flame and, moreover, to discriminate between the spectral energy of a hydrocarbon flame and that of other common light sources. The spectral energies characteristic of common light sources, such as solar radiation, a mercury lamp, a tungsten lamp, a warm, white fluorescent lamp, and galium arsenide (GaAs) electro-luminescense, are shown in FIG. 3, together with that of a hydrocarbon flame. The electrical signal generated by each of the combinations of photocell and filter utilized in flame detector 11, i.e, (i) photocell 12 and filter 14 and (ii) photocell 16 and filter 18, is a function of the spectral energy characteristic of the light source (as shown in FIG. 3) and the spectral response characteristics of the photocell filter combination (as shown in FIG. 6). The resultant signals generated when typical light sources illuminate the photocell/filter combinations comprising the flame detector 11 are shown in FIGS. 7*a* and 7*b*. FIG. 7*a* shows the signals generated in response to incident light energy from a mercury lamp, solar radiation and a hydrocarbon flame. FIG. 7*b* shows the corresponding signals generated in response to incident light energy from a tungsten lamp, a white fluorescent lamp and GaAs electro-luminescense.

With reference to the electrical signals shown in FIGS. 7*a* and 7*b*, the means by which the present invention 10 can distinguish a hydrocarbon flame from among other common sources of light becomes apparent. For convenience, the electrical signal output by the combination of selenium photocell 16 and filter 18 will be referred to as the "blue signal" (since this combination is generally responsive in the blue region of the visible spectrum) and the signal output by the combination of silicon photocell 12 and filter 14 will be referred to as "red signal" (since the latter combination is generally responsive in the infrared region of the spectrum). It is seen that illumination from a mercury lamp and solar radiation results in a blue signal which is substantially greater than the red signal. Illumination from warm, white fluorescent and tungsten lamps results in a red signal which is greater than the blue signal, but where the blue signal is nevertheless of moderate strength relative to the red. It is only the illumination of a hydrocarbon flame that results in red signal which is substantially greater than the blue. Thus, it is the unique response of the pair of the above-described photocell/filter combinations to the spectral energy of a hydrocarbon flame which, in combination with sensing amplifier 20, enables the flame detector 11 to respond only to a hydrocarbon flame and not to other common sources of light. In essence, this invention takes advantage of the unique "signature" of a hydrocarbon flame; i.e., the fact that it has a relatively high spectral energy content in the upper wavelength range from 0.8 to 1.1 microns, whereas other common light sources have relatively high spectral energy in both the upper range and the lower wavelength range from 0.3 to 0.5 microns, or just in the lower range alone.

It should be pointed out that the photocells 12 and 16 are not only responsive to incident light energy, but they are directional as well. The directionality of the photocells follows the familiar cosine law; i.e., the photocells respond fully to spectral energy incident from a direction perpendicular to the plane of the photocells, while there is no response to spectral energy whose angle of incidence is $\pm 90°$ from the perpendicular. The spectral response of the photocells to light incident from angles between 0° and $\pm$ 90° is reduced by the cosine of the angle of incidence. In addition, the signal intensity of a flame decreases by the familiar distance square law.

The capability of flame detector 11 to respond to a hydrocarbon flame is a function of several variables; these include the intensity of the flame, its distance from the detector 11, the angle of incidence with respect to an axis perpendicular to the plane of the photocells 12 and 16, the sensitivity of the photocells, the intensity of background illumination relative to that of the flame and the source or sources of the background illumination. Given the sensitivity typical selenium and silicon photocells, the above-described embodiment of the flame detector 11 is capable of detecting a standard one square foot fire pan at a distance of 20 feet "on axis" (i.e., perpendicular to the plane of the photocells and at 14 feet at 60° "off axis".

The typical effect of background illumination is to generate a false blue or a false red signal and, correspondingly, to either desensitize or oversensitize the flame detector 11. For example, background illumination from sunlight will tend to desensitize flame detector 11 because it produces a blue signal which is uncharacteristic of a hydrocarbon flame. Thus, in order for a hydrocarbon flame to be detected, the intensity of the flame must be sufficiently great so as to make the red signal substantially greater than the "false" blue signal. On the other hand, background illumination from a tungsten or warm, white fluorescent lamp tends to make flame detector 11 more sensitive because it produces a red signal characteristic of a hydrocarbon flame. Thus, it only takes a relatively weak hydrocarbon flame to bring the overall red signal strength to a level sufficient to cause the detector 11 to respond. The undesirable effects of background illumination can be mitigated, to some extent, by carefully selecting the placement of the flame detector 11 within the room or structure and by electronics means in the sensing amplifier 20. For example, with respect to placement, flames detector 11 should not be located directly opposite windows or over lamps, but rather should face away from direct illumination from any source of light.

In any application utilizing the present invention, more than one flame detector 11 may be used for greater coverage. Configurations comprising more than five flame detectors 11 are preferably interconnected to control amplifier 21 through blocking diodes. When five or less detectors 11 are used, diode blocking may not necessary. In any event, multiple flame detectors 11 are typically interconnected so that flame detection by any one of the detectors is all that is required to generate a control signal for transmission to control amplifier 21. However, this invention also contemplates multiple flame detector configurations where two or more detectors must detect a flame before a response is generated; the latter configurations being typically those wherein the prevention of false alarms is of particular importance.

The Sensing Amplifier

As indicated above, a sensing amplifier 20 is part of flame detector 11. The photocells 12 and 16 are electrically coupled to sensing amplifier 20, which, in turn, is electrically coupled to control amplifier 21. Sensing amplifier 20 is a binary, high speed switching circuit whose basic function is to provide a control signal to control amplifier 21 whenever the red signal is substantially greater than the blue signal; i.e., when a hydrocarbon flame is detected. At all other times, its function is to provide a turn-off or neutral voltage in darkness, or when the flame detector 11 is illuminated by any light source other than hydrocarbon flame.

Figure 8:
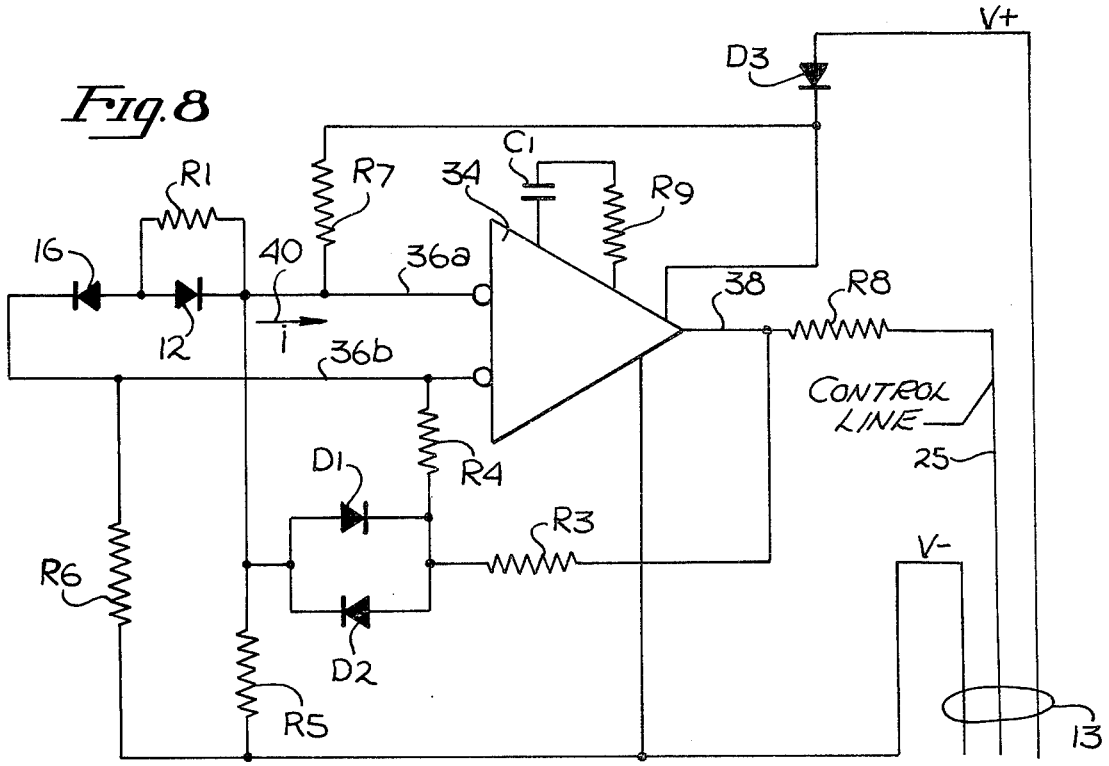
FIG. 8 is a schematic representation of the sensing amplifier portion of the present invention.

With reference to FIG. 8, a preferred embodiment of sensing amplifier 20 is now described. It is comprised of (i) an operational amplifier 34 having two input legs 36*a* and 36*b* respectively; (ii) photocells 12 and 16 serially connected in opposition between input legs 36*a* and 36*b*, thereby forming an input current loop; (iii) a resistor $R_1$ connected in parallel across photocell 12, the value of resistor $R_1$ being selected to balance the impedance difference between photocells 12 and 16; (iv) a feedback circuit between the output 38 of operational amplifier 34 and its input leg 36*b*, the feedback circuit comprising a resistor $R_3$ connected at one end to output 38 and at its other end to a pair of parallel diodes, $D_1$ and $D_2$, connected in opposition, and a resistor $R_4$ connected at one end to the junction of $R_3$ and the pair of diodes and at its other end to input leg 36*b*, the second end of the diode pair being connected to input leg 36*a;* (v) a voltage divider comprised of resistor $R_5$ and $R_7$, resistor $R_5$ being connected between leg 36*a* and supply line V− and resistor $R_7$ being connected between leg 36*a* and supply line V+ through protective diode $D_3$; (vi) bias resistor $R_6$ connected between leg 36*b* and supply V−; and (vii) output resistor $R_8$ which couples the output 38 of operational amplifier 34 to the input of control amplifier 21 via control line 25. Supply lines V+ and V− are also connected to the operational amplifier 34 as required.

The operational amplifier 34 is a conventional electronic device whose output 38 is a function of the voltage appearing on its input legs 36*a* and 36*b*. This function is described as follows:

(1) When $V_{36b} > V_{36a}$, the voltage at output 38 ≅ V+ volts; and
(2) When $V_{36a} > V_{36b}$, the voltage at output 38 ≅ V− volts, where $V_{36a}$ is the voltage between leg 36*a* and circuit common, and $V_{36b}$ is the voltage between leg 36*b* and circuit common.

Operational amplifiers having the foregoing characteristic are well known in the art. A preferred device is available from Fairchild Semiconductor as part number Fμ5B7709312, commonly referred to in the trade as the "709" operational amplifier. This particular part is preferred because of its relatively low leakage and its lower input current requirement. In addition, the operational amplifier known in the art as the "741" is also suitable for use in sensing amplifier 20. When the "709" operational amplifier is used, it requires an external frequency compensation network across terminals provided therefor. Without such a network, the "709" operational amplifier is unstable. Resistor $R_9$ and capacitor $C_1$ are included in the sensing amplifier circuit 20 to provide the requisite frequency compensation network. The values of $R_9$ and $C_1$ are selected to set the frequency response of the operational amplifier.

As indicated above, photocells 12 and 16 are connected in opposition so as to form an input current loop; moreover, they generate the red signal and the blue signal respectively. For the reasons described above, the red signal is substantially greater than the blue only when the spectral energy from hydrocarbon flame is incident upon the photocells 12 and 16 (through filters 14 and 18 respectively). On the other hand, the presence of other light sources causes either (i) the blue signal to be substantially greater than the red, or (ii) the red signal to be only moderately greater than the blue signal. In any event, when the blue signal is substantially greater than the red, a positive current *i* flows into leg 36*a* and out of leg 36*b;* i.e., in the direction shown by arrow 40. As a result of the voltage drop across photocells 12 and 16, the voltage at leg 36*a* ($V_{36a}$) is greater than the voltage at leg 36*b* ($V_{36b}$); thus, the voltage at output 38 is V− volts, in accordance with equation (2) above. When the blue signal and the red signal are sufficiently strong to approximately cancel each other out (or, as in the case of darkness, when the blue and red signals are each close to zero), $V_{36a}$ is approximately equal to $V_{36b}$. Under such conditions, the output 38 of operational amplifier 34 is maintained at V− volts as a result of a bias current flowing out of leg 36*b* through bias resistor $R_6$. Thus, the bias current assures that output 38 of operational amplifier 34 is at V− volts at all times except when a hydrocarbon flame is detected. When a hydrocarbon flame of sufficient intensity comes with the range and field of view of flame detector 11, the red signal generated is substantially greater than the blue, causing a relatively large positive current *i* to flow in a direction opposite to direction 40; i.e., out of leg 36*a* and into leg 36*b*. As a result, the effect of the bias current through resistor $R_6$ is overcome, and the voltage drop across photocells 12 and 16 is sufficent to cause $V_{36b}$ to become greater than $V_{36a}$. Under these conditions, the output 38 of operational amplifier 34 changes to V+ volts in accordance with equation (1). In the cases of a warm, white fluorescent lamp and a tungsten lamp, the magnitude of the red signal is not sufficiently greater than that of the blue signal to achieve the requisite voltage drop across photocells 12 and 16 necessary to overcome the bias current and cause the output 38 of operational amplifier 34 to change its state. Thus, the presence of a V− volts at output 38 is indicative of a non-flame condition, while a voltage of V+ volts is indicative of a hydrocarbon flame condition. The appearance of voltage V+ at the output 38 is the control signal to control amplifier 21. As indicated above, the control signal is coupled to control amplifier 21 through output resistor $R_8$ and control line 25.

The main purpose the feedback circuit comprised of opposing diodes $D_1$ and $D_2$ and resistors $R_3$ and $R_4$ is to make the sensing amplifier 20 function more decisively; i.e., to prevent vascillation between its two states (such as might otherwise occur, for example, when the flame intensity flickers near the threshold of response). This is achieved in the following manner: When the output 38 of the operational amplifier 34 is at V− volts, the voltage at the junction of resistors $R_3$ and $R_4$ is slightly less than the voltage at leg 36*a*, the latter being determined by the voltage divider comprised of resistors $R_5$ and $R_7$. The slightly lower voltage at the junction of $R_3$ and $R_4$ is due to the voltage drop across diode $D_1$. This voltage condition has the effect of drawing additional current out of leg 36*b*, in addition to the bias current through resistor $R_6$. As discussed above, output 38 changes from V− to V+ volts whenever $V_{36b}$ is greater than $V_{36a}$. At some point during this change of state, when the voltage at output 38 rises to a level greater than $V_{36a}$, the current through $R_3$ reverses and begins to flow through diode $D_2$ instead of diode $D_1$. Consequently, there is a sudden reversal of the voltage drop across the diodes. This, in turn, causes a reversal of the current through $R_4$; i.e., additional current flows into leg 36*b*, thereby enhancing the tendency of the operational amplifier 34 to change its state. The reverse takes place when the voltage at output 38 changes back from V+ to V− volts; i.e., when the control signal is removed, after the flame has been extinguished or otherwise removed.

The Control Amplifier

Control amplifier 21 is comprised of (i) an input transistor $T_1$ whose collector is coupled to supply line V+ through resistor $R_{10}$ and protective diode $D_3$, whose emitter is coupled to supply line V− through a pair of serially connected forward biased diodes $D_4$ and $D_5$ and resistor $R_{11}$, and whose base is the input coupled to the output 38 of sensing amplifier through control line 25 and resistor $R_8$; (ii) transistor switches $T_2$ and $T_3$ connected in a Darlington configuration, the base of transistor $T_2$ being connected to the junction of diode $D_5$ and resistor $R_{11}$; (iii) resistor $R_{12}$ connected between the emitter of transistor $T_2$ and supply line V−; (iv) diode $D_6$ connected between the emitter of transistor $T_3$ and supply line V−; and (v) the parallel combination of diode $D_7$ and capacitor $C_2$ across the output terminals 50*a* and 50*b* of control amplifier 21. Output terminals 50*a* is coupled to supply line V+ through protective diode $D_3$, while output terminal 50*b* is the common collector of transistors $T_2$ and $T_3$. The coil of a control relay and/or solenoid 27 is connected across output terminals 50*a* and 50*b*.

When the input voltage to transistor $T_1$ is V−, i.e., the non-flame condition, $T_1$ does not conduct. Therefore, the voltage at the base of transistor $T_2$ is V− and, consequently, $T_2$ does not conduct. Similarly, the voltage at the base of transistor $T_3$ if V− and $T_3$ does not conduct. Thus, there is no path for current to flow through the coil of relay and/or solenoid 27. Diodes $D_4$ and $D_5$ are included in the input circuit of transistor $T_2$ to ensure that $T_2$ is not turned on as a result of leakage current through transistor $T_1$, such leakage being possible if the output of sensing amplifier 20 is less negative than V−. Diode $D_6$ serves the same purpose with respect to leakage through transistor $T_2$.

When a flame condition is detected, the input to the base of transistor $T_1$ is V+, causing $T_1$ to switch to a conducting state. The resulting current through transistor $T_1$ provides a sufficient voltage drop across resistor $R_{11}$ to switch transistors $T_2$ and $T_3$ into conducting states. Thus, a parallel path is provided for current through the coil of relay and/or solenoid 27, thereby activating whatever fire alarm and/or extinguishing means 29 is used. Capacitor $C_1$ and diode $D_7$ across the coil of relay and/or solenoid 27 prevent the inductive transient, which is generated when the coil current is broken, from damaging the transistors $T_2$ and $T_3$.

Although this invention has been disclosed and described with reference to a particular embodiment, the principles involved are susceptible of other applications which will be apparent to persons skilled in the art. This invention, therefore, is not intended to be limited to the particular embodiment herein disclosed. For example, the present invention also contemplates the use of a suitable lens system to extend the range and field of view of the flame detector 11.

We claim:

1. A flame detector comprising photovoltaic means disposed to receive light from a flame for producing an electrical signal having a first voltage polarity in response to receiving light having a first spectral energy distribution and for changing the polarity of said electrical signal in response to receiving light having a second spectral energy distribution, the second spectral energy distribution corresponding to the spectral energy distribution of light from a selected flame; and electronic binary switching means coupled to receive the electrical signal for producing a control signal in response to said electrical signal changing polarity.

2. A flame detector as in claim 1 wherein photovoltaic means comprise:

a first combination of a first photovoltaic sensor and a first light filter mounted in planar juxtaposition within a housing, said first combination having a spectral response in a first region of the light spectrum, said first region being that portion of the spectrum wherein the spectral energy from a hydrocarbon flame is relatively sparse;

a second combination of a second photovoltaic sensor and a second light filter mounted in planar juxtaposition within said housing, said second combination having a spectral response in a second region of the light spectrum, said second region being that portion of the spectrum wherein the spectral energy from a hydrocarbon flame is relatively abundant; and means for serially coupling the first and second photovoltaic sensors in polarity opposition to provide an electrical signal having the second polarity only when said second photovoltaic sensor generates a voltage which is substantially greater than that generated by said first photocell, whereby said flame detector discriminates a hydrocarbon flame within the range and field of view of said photovoltaic sensors from other common sources of illumination.

3. The flame detector of claim 2 wherein the spectral response of said first combination of said first photovoltaic sensor and said first filter is in the range from about 0.3 to 0.5 microns with a peak between about 0.4 and 0.45 microns.

4. The flame detector of claim 2 wherein said first photovolaic sensor is a selenium photovoltaic cell diode and said first filter is one whose transmittance characteristic is similar to that of a Wratten gelatin filter No. 35.

5. The flame detector of claim 2 wherein the spectral response of said second combination of said second photovoltaic sensor and said second filter is in the range from about 0.9 microns to 1.1 microns with a peak between about 1.0 and 1.05 microns.

6. The flame detector of claim 5 wherein said second photovoltaic is a silicon photovoltaic cell diode and said second filter is one whose transmittance characteristic is similar to that of a Wratten gelatin filter No. 87A.

7. The flame detector of claim 2 wherein said first and second photovoltaic sensors are mounting on a board in a substantially co-planar, adjacent spatial relation.

8. The flame detector of claim 2 wherein said first and second filters are selective glass filters.

9. The flame detector of claim 2 wherein said first and second filters are disposed on the backside of a filter reticle in a substantially co-planar, adjacent spatial relation.

10. The flame detector of claim 9 wherein said filter reticle is a glass having an opaque portion and first and second clear portions, said first and second filters being disposed on said reticle at the locations defined by said first and second clear portions respectively.

11. The flame detector of claim 9 wherein first and second filters are secured to said reticle by an adhesive, said adhesive being transparent over the transmittance range of said filters and having no adverse effect thereon.

12. The flame detector of claim 9 wherein said filters are secured to said reticle by vacuum deposition techniques.

13. The flame detector of claim 2 wherein said first and second photovoltaic sensors are mounted on a circuit board and said first and second filters are disposed upon a filter reticle, the locations of said photovoltaic sensors on said board and the locations of said filters on said reticle being such that said first filter covers substantially all of the surface of said first photovoltaic sensor and said second filter covers substantially all of the surface of said second photocell photovoltaic sensor.

14. The flame detector of claim 2 wherein said housing has an opening in its face, said opening enabling spectral energy from light sources to pass through said first and second filters.

15. The flame detector of claim 2 wherein the respective surface areas of said first and second photovoltaic sensors are such that differences in their respective sensitivities and efficiencies are substantially balanced out.

16. The flame detector of claim 2 wherein said first photovoltaic sensor is a selenium photovoltaic cell diode and said second photovoltaic sensor is a silicon photovoltaic cell diode, the surface of said first photovoltaic sensor being greater than that of said second photovoltaic sensor by that amount which substantially balances out differences in their respective sensitivities and efficiencies.

17. The flame detector of claim 2 wherein said second photovoltaic sensor has a higher impedance than said first photovoltaic sensor and wherein an impedance is coupled in parallel across said second photovoltaic sensor, the differences in their respective impedances being thereby substantially balanced out.

18. In an electrically-powered flame detection system, a flame detector comprising:

a. a first combination of a first photocell and a first light filter mounted in planar juxtaposition within a housing, said first combination having a spectral response in a first region of the light spectrum, said first region being that portion of the spectrum wherein the spectral energy from a hydrocarbon flame is relatively sparse;

b. a second combination of a second photocell and a second light filter mounted in a planar juxtaposition within said housing, said second combination having a spectral response in a second region of the light spectrum, said second region being that portion of the spectrum wherein the spectral energy from a hydrocarbon flame is relatively abundant;

c. a binary high-speed switching circuit having an input and an output, said first and second photocells being electrically coupled to said input in opposing direction, said sensing amplifier being arranged and configured to provide a control signal at its output only when said second photocell generates an electrical signal which is substantially greater than that generated by said first photocell, whereby, said flame detector discriminates a hydrocarbon flame within the range and field view of said photocells from other common sources of illumination and said sensing amplifier provides said control signal in response thereto, said switching circuit being comprised of (i) an operational amplifier having first and second input legs, said operational amplifier being arranged and configured to provide said control signal at said output when the voltage at said second input leg is greater than that at said first input leg; (ii) a voltage divider providing a substantially constant voltage at said first input leg; (iii) a feedback circuit coupled between the output of said operational amplifier and said second input leg; and (iv) a bias resistor coupled to said second input leg, said bias resistor providing a bias current in a direction which tends to suppress the appearance of said control signal, said first and second photocells being serially connected in opposition between said first and second input legs.

19. In an electrically powered flame detection system, a flame detector comprising:

a. a first combination of a first photocell and a first light filter mounted in planar juxtaposition within a housing, said first combination having a spectral response in a range of about 0.3 to 0.5 microns with a peak between about 0.4 and 0.45 microns;

b. a second combination of a second photocell and a second light filter mounted in planar juxtaposition within said housing, said second combination having a spectral response in the range from about 0.9 microns with a peak between about 1.0 and 1.05 microns;

c. a board adapted to fit within said housing, said first and second photocells being mounted thereon in a substantially co-planar adjacent spatial relation;

d. a filter reticle adapted to fit within said housing, said first and second filters being fixedly secured thereon in a substantially co-planar, adjacent spatial relation, the respective locations of said photocells on said board and the locations of said filters on said reticle being such that said first filter covers substantially all of the surface of said first photocell and said second filter covers substantially all of the surface of said second photocell; and e. a binary, high speed switching circuit having an input and an output, said first and second photocells being electrically coupled to said input in opposing directions, said sensing amplifier being arranged and configured to provide a control signal at its output only when said second photocell generates an electrical signal which is substantially greater than that generated by said first photocell;

said switching circuit being comprised of (i) an operational amplifier having first and second input legs, said operational amplifier being arranged and configured to provide said control signal at said output when the voltage at said second input leg is greater than that at said first input leg; (ii) a voltage divider providing a substantially constant voltage at said first input leg; (iii) a feedback circuit coupled between the output of said operational amplifier and said second input leg; and (iv) a bias resistor providing a bias current in a direction which tends to suppress the appearance of said control signal, said first and second photocells being serially connected in opposition between said first and second input legs.

20. An electrically powered flame detection system for activating a fire alarm and/or extinguishing means upon the detection of a hydrocarbon flame, said system being coupled to said alarm and/or extinguishing means by a means for switching power on, comprising:

a. a first combination of a first photocell and a first light filter mounted in planar juxtaposition within a housing, said first combination having a spectral response in a first region of the light spectrum, said first region being that portion of the spectrum wherein the spectral energy from a hydrocarbon flame is relatively sparse;

b. a second combination of a second photocell and a second light filter mounted in planar juxtaposition within said housing, said second combination having a spectral response in a second region of the light spectrum, said second region being that portion of the spectrum wherein the spectral energy from a hydrocarbon flame is relatively abundant; and c. a sensing amplifier having an input and an output, said first and second photocells being electrically coupled to said input in opposing directions, said sensing amplifier being arranged and configured to provide a control signal at its output only when said second photocell generates an electrical signal which is substantially greater than that generated by said first photocell; and d. a control amplifier having an input and an output, said input thereof being electrically coupled to the output of said sensing amplifier for receipt of said control signal, said output thereof being electrically coupled to said power switching means, said control amplifier being responsive to said control signal by energizing said power switching means, said sensing amplifier being a binary, high speed switching circuit comprised of (i) an operational amplifier having first and second input legs, said operational amplifier being arranged and configured to provide said control signal at said output when the voltage at said second input leg is greater than that at said first input leg; (ii) a voltage divider providing a substantially constant voltage at said first input leg; (iii) a feedback circuit coupled between the output of said operational amplifier and said second input leg; and (iv) a bias resistor coupled to said second leg, said bias resistor providing a bias current in a direction which tends to suppress the appearance of said control signal, said first and second photocells being serially connected in opposition between said first and second input legs.

* * * * *